US010155600B2

(12) United States Patent
Birch

(10) Patent No.: US 10,155,600 B2
(45) Date of Patent: Dec. 18, 2018

(54) APPARATUS FOR VACUUM SEALING PRODUCTS

(71) Applicant: William Terence Birch, Campbell field (AU)

(72) Inventor: William Terence Birch, Campbell field (AU)

(73) Assignee: STARVAC SYSTEMS PTY LTD, Victoria (AU)

( * ) Notice: Subject to any disclaimer, the term of this patent is extended or adjusted under 35 U.S.C. 154(b) by 0 days.

(21) Appl. No.: 15/392,778

(22) Filed: Dec. 28, 2016

(65) Prior Publication Data

US 2017/0183112 A1 Jun. 29, 2017

Related U.S. Application Data

(60) Provisional application No. 62/271,646, filed on Dec. 28, 2015.

(51) Int. Cl.

| | |
|---|---|
| ***B65B 31/02*** | (2006.01) |
| ***B65B 65/02*** | (2006.01) |
| ***B65B 43/52*** | (2006.01) |
| ***B65B 25/00*** | (2006.01) |
| ***B65B 57/00*** | (2006.01) |
| ***B65B 61/28*** | (2006.01) |

(52) U.S. Cl.

CPC ..... *B65B 31/02* (2013.01); *B65B 25/001* (2013.01); *B65B 43/52* (2013.01); *B65B 57/00* (2013.01); *B65B 61/28* (2013.01); *B65B 65/02* (2013.01)

(58) Field of Classification Search

CPC ..... B65B 31/02; B65B 25/001; B65B 61/28; B65B 65/02; B65B 43/52; B65B 57/00

USPC ..... 53/510

See application file for complete search history.

(56) References Cited

U.S. PATENT DOCUMENTS 3,096,181 A * 7/1963 Dixon ..... A23B 7/148 426/418
4,779,398 A * 10/1988 Glandon ..... B65B 31/08 53/434
4,869,050 A * 9/1989 Furukawa ..... B65B 31/022 53/432

(Continued)

FOREIGN PATENT DOCUMENTS

WO WO 2007004900 A1 * 1/2007 ..... B65B 31/02

*Primary Examiner* — Hemant M Desai
*Assistant Examiner* — Valentin Neacsu

(57) ABSTRACT

The apparatus for vacuum sealing products is an automated system for packaging various products. The apparatus for vacuum sealing products has a conveyor system, a modular packaging assembly, and a chamber positioning system. The conveyor system is a material transport system and has a loading end and a drop-off end. The modular packaging assembly is a system that is used to vacuum seal the packages of various products and includes a central column and multiple openable chambers. The central column is a rigid pillar used to support the multiple openable chambers. The openable chambers function as vacuum chambers that can be switched out to vacuum seal packages of varying shape and size. The modular packaging assembly is mounted next to the drop-off end of the conveyor system. The chamber positioning system is a drive mechanism that moves the openable chambers next to and away from the drop off end.

11 Claims, 6 Drawing Sheets

(56) References Cited

U.S. PATENT DOCUMENTS

| | | | | |
|---|---|---|---|---|
| 5,961,297 | A * | 10/1999 | Haga | F04C 18/0215 417/252 |
| 7,228,674 | B2 * | 6/2007 | Evangelisti | B65B 31/024 53/510 |
| 7,296,390 | B2 * | 11/2007 | Koke | B65B 31/024 53/202 |
| 7,464,521 | B2 * | 12/2008 | Koke | B65B 31/024 53/202 |
| 7,946,099 | B2 * | 5/2011 | Sparakowski | B65B 31/043 426/112 |
| 8,524,333 | B2 * | 9/2013 | Fujinami | C23C 16/345 427/569 |
| 2004/0139701 | A1 * | 7/2004 | Cady | B29C 65/18 53/434 |
| 2005/0178090 | A1 * | 8/2005 | Koke | B65B 31/024 53/434 |
| 2006/0064946 | A1 * | 3/2006 | Evangelisti | B65B 31/024 53/510 |
| 2006/0096246 | A1 * | 5/2006 | Buchko | B65B 31/022 53/432 |
| 2006/0096247 | A1 * | 5/2006 | Buchko | B65B 31/022 53/434 |
| 2006/0182638 | A1 * | 8/2006 | Ohmi | F04B 37/14 417/87 |
| 2006/0272291 | A1 * | 12/2006 | Koke | B65B 31/024 53/432 |
| 2008/0206072 | A1 * | 8/2008 | Ohmi | F04B 37/14 417/251 |
| 2010/0115893 | A1 * | 5/2010 | Sparakowski | B65B 31/043 53/485 |
| 2011/0226405 | A1 * | 9/2011 | Nishida | B32B 37/24 156/152 |
| 2014/0360134 | A1 * | 12/2014 | Brinkman | B65B 31/02 53/405 |

* cited by examiner

APPARATUS FOR VACUUM SEALING PRODUCTS

The current application claims a priority to the U.S. Provisional Patent application Ser. No. 62/271,646 filed on Dec. 28, 2015.

FIELD OF THE INVENTION

The present invention relates generally to packaging machines. More specifically, the present invention is a modular packaging machine that is capable of packaging a number of different items including, but not limited to beef, lamb, chicken, fish, cheese, and cheese blocks. The interchangeable components and configuration of the present invention reduces manufacturing costs, increases processing flexibility, and reduces the required vacuum system capacity, thus provides a more efficient packaging system.

BACKGROUND OF THE INVENTION

A variety of different vacuum packaging machines exist today. However, such machines have a singular operation and cannot easily be modified to alter the number of packages in which the machines are capable of vacuum sealing. In this regard, the existing technology requires various vacuum packaging machines for such purposes. Further, the existing vacuum packaging machines are not flexible with regard to their overall functionality. Meaning, the existing machines cannot be mechanically modified to easily perform tasks at varying packaging speeds or modified to consume less power for less demanding tasks. Existing vacuum packaging machines have a number of additional downfalls and disadvantages in which the present invention aims to address. For example, the majority of existing vacuum packaging machines are not efficient in their operation as the overall configuration of the components (i.e. vacuum pump locations) requires a greater amount of power to operate and takes up a greater amount of floor space. Therefore, the need for an improved vacuum packaging machine is apparent.

The present invention is a modular vacuum packaging machine which aims to improve upon the vacuum packaging systems that exist today. A key feature of the present invention is its modularity and configuration of components which is geared toward allowing the vacuum packing machine to function in a variety of different ways in the most efficient manner. All functions of the vacuum packing process will be automated through the machine, and the number of packages in which the modular vacuum packaging machine is able to seal can be conveniently altered through swapping only a minimum of components. The change from one product line to another product line with increased or decreased packing requirements can be achieved by simply adding or reducing a sealing mechanism and different chambers. The present invention will be able to vacuum package a number of different products including, but not limited to, beef, lamb, chicken, fish, and cheese at varying speeds.

DETAILED DESCRIPTIONS OF THE INVENTION

All illustrations of the drawings are for the purpose of describing selected versions of the present invention and are not intended to limit the scope of the present invention.

Figure 1:
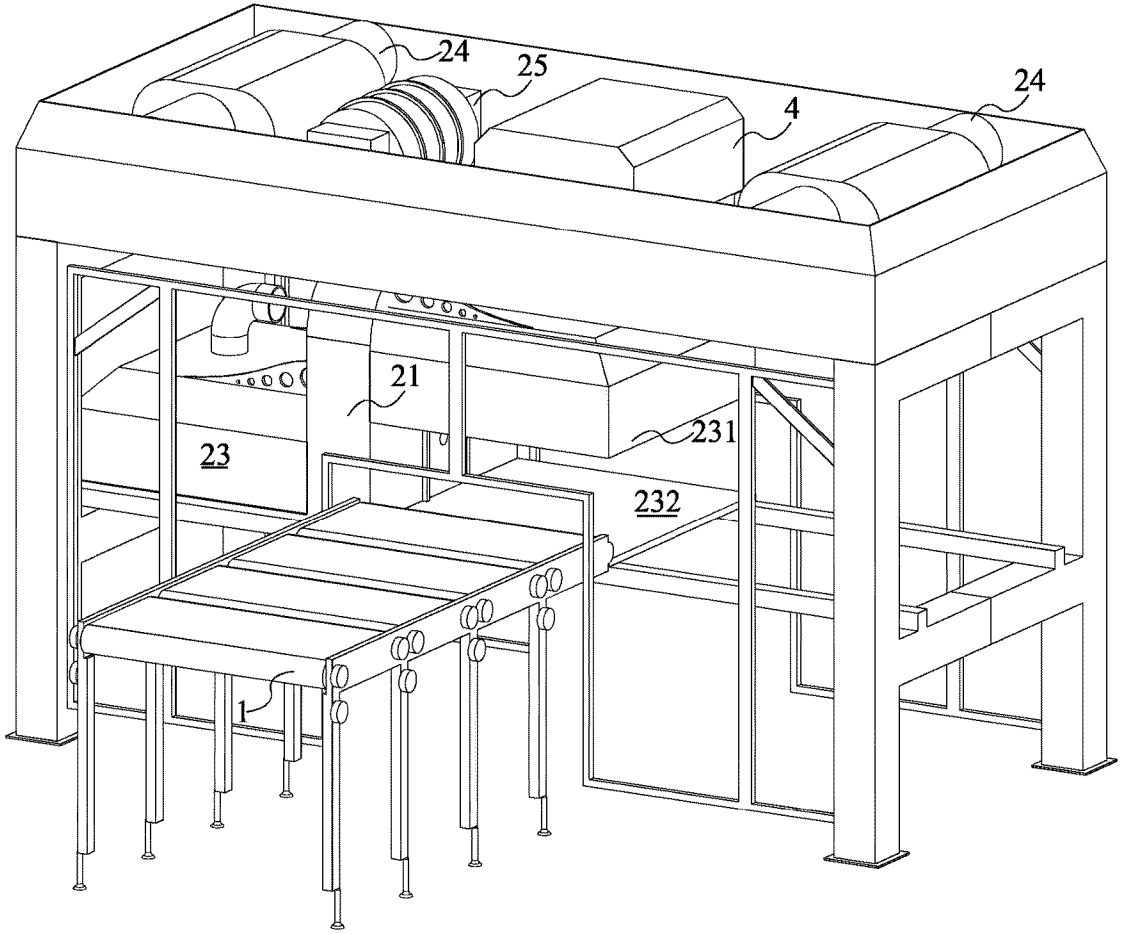
FIG. 1 is a perspective view of the present invention.
Figure 2:
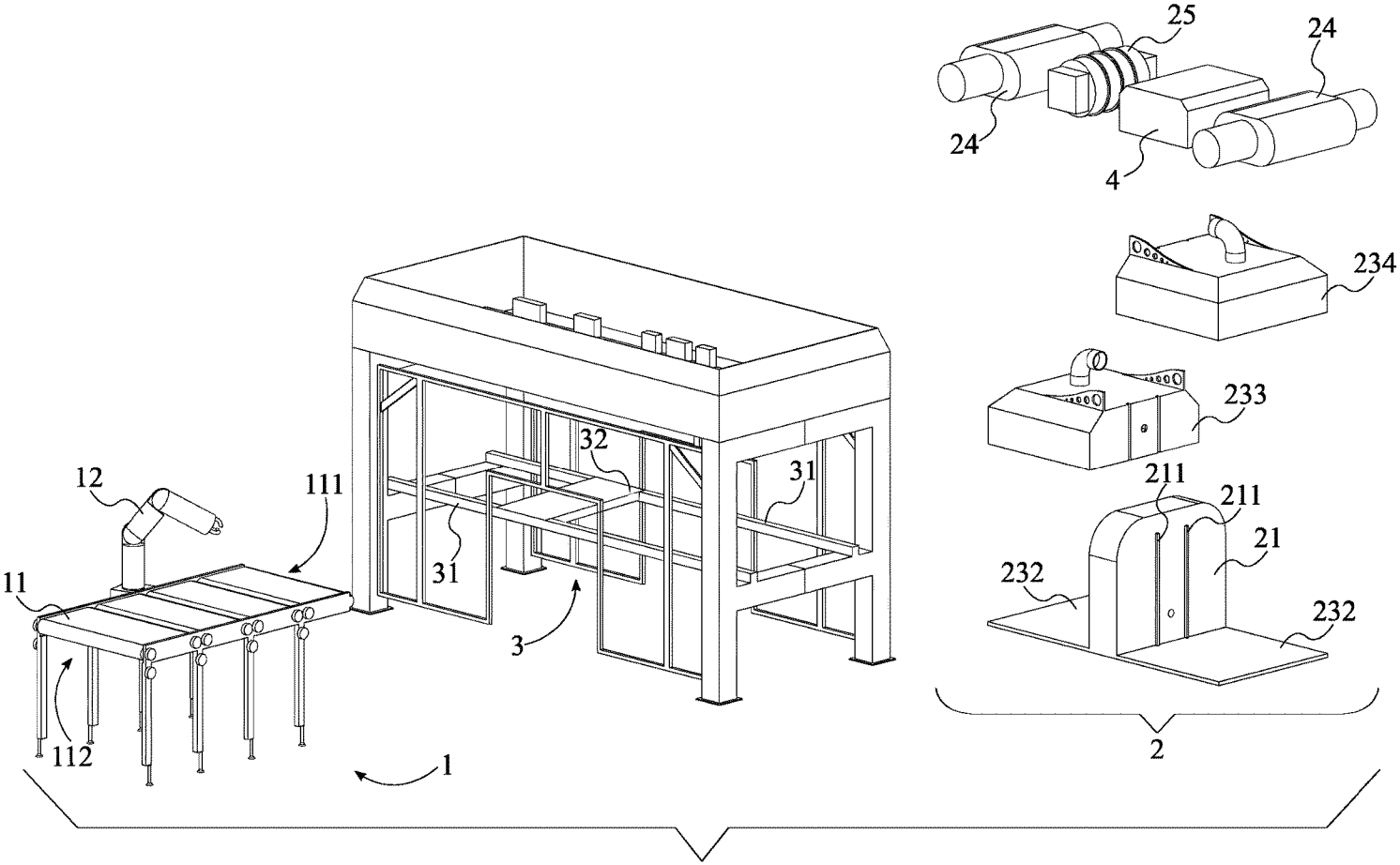
FIG. 2 is an exploded perspective view of the present invention.
Figure 3:
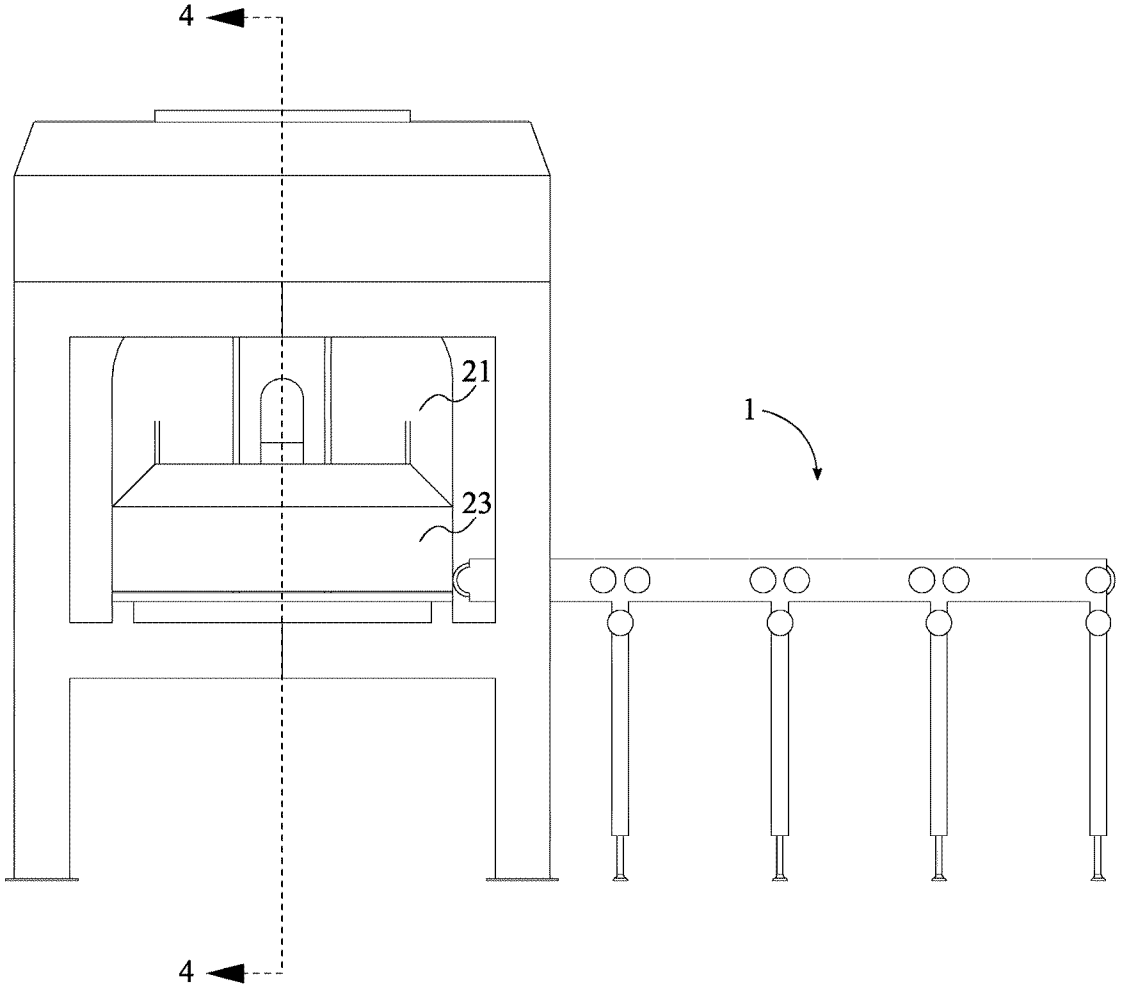
FIG. 3 is a left-side view of the present invention.

As can be seen in FIG. 1 and FIG. 2, the present invention, the apparatus for vacuum sealing products, is an automated vacuum packaging machine that is designed to seal products within vacuum packages without the need for human intervention. The present invention makes use of conveyor belts and multiple vacuum chambers to function as a self-contained vacuum packaging assembly line. The present invention comprises a conveyor system 1, a modular packaging assembly 2, and a chamber positioning system 3. The conveyor system 1 is a collection of devices designed to move packages into the modular packaging assembly 2. The modular packaging assembly 2 is a system that performs the vacuum sealing operations of the present invention. To accomplish this, the modular packaging assembly 2 comprises a central column 21 and a plurality of openable chambers 23. The modular packaging assembly 2 is mounted adjacent to a drop-off end 111 of the conveyor system 1 so that products moving off the conveyor system 1 can be deposited into the modular packaging assembly 2, and subsequently vacuum packaged. The plurality of openable chambers 23 is the collection of vacuum chambers which are used to vacuum seal the packages that are supplied by the drop-off end 111 of the conveyor system 1. Additionally, the central column 21 is a rigid pillar that is used to support the plurality of openable chambers 23. More specifically, the plurality of openable chambers 23 is mounted onto the central column 21. As a result, the plurality of openable chambers 23 is maintained in a desired position and orientation by the central column 21. The chamber positioning system 3 is a drive mechanism that moves the modular packaging assembly 2 into positions that move the plurality of openable chambers 23 next to, and away from the drop-off 111 end of the conveyor system 1. The chamber positioning system 3 is operatively coupled to the modular packaging assembly 2 wherein the chamber positioning system 3 cycles each of the plurality of openable chambers 23 to be adjacent to the drop-off end 111. Thus, the chamber positioning system 3 moves one or more of the plurality of openable chambers 23 into a position where packages leaving the conveyor system 1 can enter the modular packaging assembly 2.

As can be seen in FIG. 1 and FIG. 2, in the present invention, the conveyor system 1 employs at least one belt conveyor 11. Consequently, the conveyor system 1 is able to convert a continuous product flow into a batch supply and therefore function as a batch conveyor that can selectively move any portion of the packages being conveyed. Additionally, the conveyor system 1 further comprises a loading end 112. The loading end 112 is positioned opposite to the drop-off end 111 along the conveyor system 1. Accordingly, packages are placed onto the conveyor system 1 at the loading end 112 and transferred off the conveyor system 1 at the drop-off end 111. The present invention further comprises at least one robotic manipulator 12 that is preferably a robotic arm with mechanical graspers. The at least one robotic manipulator 12 is mounted along the conveyor system 1 between the loading end 112 and the drop-off end 111 so that the at least one robotic manipulator 12 is able to reposition and manipulate packages moving along the conveyor system 1.

As can be seen in FIG. 1, in the present invention, the modular packaging assembly 2 further comprises at least one vacuum supply pump 24. The at least one vacuum supply pump 24 is a vacuum pump used to supply the requisite vacuum for the plurality of openable chambers 23. To that end, each of the plurality of openable chambers 23 is in fluid communication with the at least one vacuum supply pump 24. As a result, the at least one vacuum supply pump 24 is able to selectively depressurize each of the plurality of openable chambers 23. The at least one vacuum supply pump 24 can be, but is not limited to, a dry running vacuum pump, a positive displacement pump, a momentum transfer pump, a regenerative pump, or an entrapment pump. Additionally, the modular packaging assembly 2 further comprises at least one booster pump 25. The at least one booster pump 25 is a supplementary airflow control system that increases the pumping speed of the at least one vacuum supply pump 24. Each of the at least one vacuum supply pump 24 is in fluid communication with the at least one booster pump 25 to improve the vacuum supply pump's 24 overall function.

Figure 5:
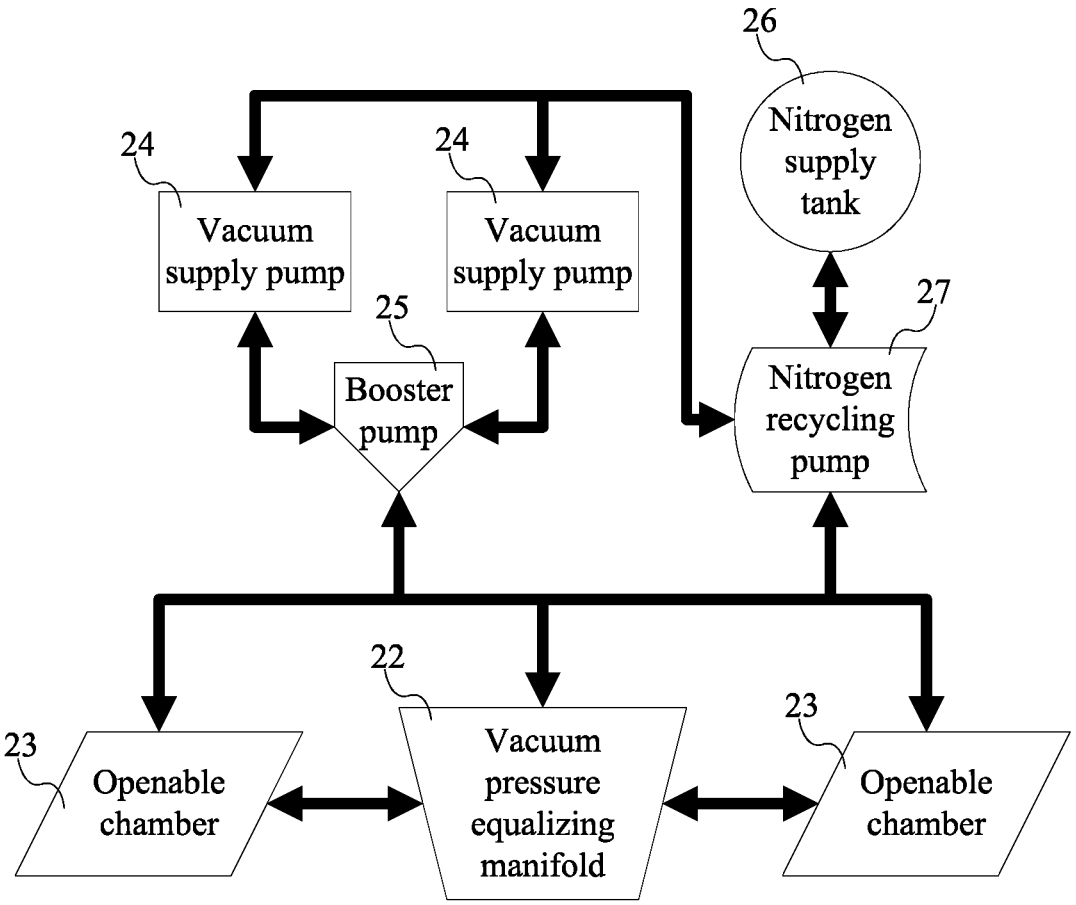
FIG. 5 is a flow diagram illustrating the fluid communication between the components of the present invention.

As can be seen in FIG. 5, in the present invention, the modular packaging assembly 2 further comprises a nitrogen supply tank 26 and a nitrogen-recycling pump 27. The nitrogen supply tank 26 is a reservoir of nitrogen gas that can be drained and refilled as desired. The nitrogen-recycling pump 27 is a pump used to move quantities of nitrogen gas from one enclosure into another enclosure. Each of the plurality of openable chambers 23 is in fluid communication with the nitrogen-recycling pump 27. Thus, the nitrogen-recycling pump 27 is able to selectively supply nitrogen gas to each of the plurality of openable chambers 23. Additionally, the nitrogen-recycling pump 27 is able to supply and extract nitrogen to the plurality of openable chambers 23. The nitrogen-recycling pump 27 is in fluid communication with the nitrogen supply tank 26. Consequently, the nitrogen supply tank 26 is able to provide the requisite nitrogen for filling and flushing the plurality of openable chambers 23 with nitrogen. The nitrogen recycling pump 27 makes use of nitrogen to sterilize the packages being vacuum sealed. In the preferred embodiment of the present invention the at least one vacuum supply pump 24 is a dry running vacuum supply pump. The nitrogen-recycling pump 27 is preferably used with dry running vacuum supply pumps 24. This configuration prevents liquids from contaminating the nitrogen flowing through the system. Additionally, the nitrogen-recycling pump 27 necessitates the use of a dry running vacuum pump. All embodiments of the present invention designed with the nitrogen-recycling pump 27 are designed with dry running vacuum pumps.

Figure 4:
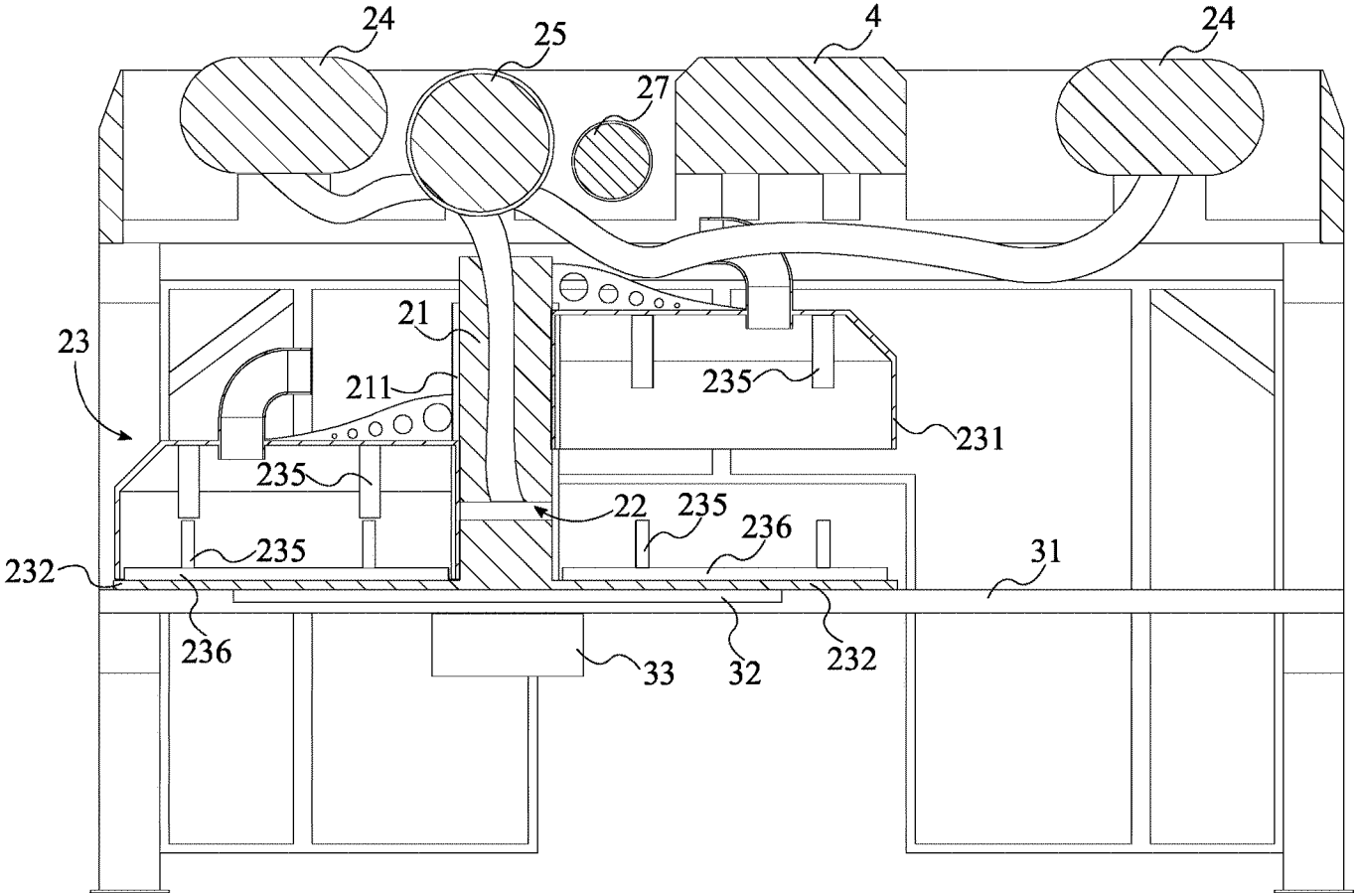
FIG. 4 a cross-sectional view of the present invention taken along the line 4-4 in FIG. 3.

As can be seen in FIG. 2 and FIG. 4, in the present invention, the modular packaging assembly 2 further comprises a plurality of chamber opening mechanisms 211. Each of the plurality of chamber opening mechanisms 211 is an actuation mechanism such as a chain or belt drive, a hydraulic cylinder, a lever assembly, an electrical motor, or similar mechanism. Each of the plurality of chamber opening mechanisms 211 is operatively coupled in between the central column 21 and a corresponding openable chamber from the plurality of openable chambers 23, wherein each of the plurality of chamber opening mechanisms 211 is used to open or close the corresponding openable chamber. Accordingly, the plurality of chamber opening mechanisms 211 is used to open the plurality of openable chambers 23 so that the packages being supplied by the conveyor system 1 can be placed into the plurality of openable chambers 23. Once the packages are placed into the plurality of openable chambers 23, the plurality of chamber opening mechanisms 211 close the plurality of openable chambers 23; enabling the plurality of openable chambers 23 to evacuate and seal the packages. Finally, after the packages have been evacuated and sealed, the plurality of chamber opening mechanisms 211 opens the plurality of openable chambers 23 so that the sealed packages can be removed. In a supplementary embodiment of the present invention, the each of the plurality of openable chambers 23 is equipped with a chamber door. In this embodiment, the chamber opening mechanisms 211 is used to open and close the chamber doors.

As can be seen in FIG. 2, FIG. 4 and FIG. 5, in the present invention, the modular packaging assembly 2 further comprises a pressure equalizing manifold 22. The pressure equalizing manifold 22 is a control system that uses valves to govern the flow of a fluid between two or more enclosures. The plurality of openable chambers 23 comprises a first chamber 233 and at least one second chamber 234, wherein the first chamber 233 is at a lower pressure than the second chamber 234 so that gasses within the second 234 chamber is compelled to flow into the first chamber 233. The first chamber 233 and the second chamber 234 are in fluid communication with each other through the pressure equalizing manifold 22. As a result, the pressure equalizing manifold 22 can be used to permit or restrict the flow of gasses between the first chamber 233, the second chamber 234, or the pressure equalizing manifold 22. This enables the pressure equalizing manifold 22 to bring the pressure between the first chamber 233 and the second chamber 234 into equilibrium, if desired. By equalizing the pressure between the first chamber 233 and the second chamber 234, the pressure equalizing manifold 22 reduces the energy required to induce a vacuum within the second chamber.

As can be seen in FIG. 4, in the present invention, each of the plurality of openable chambers 23 comprises a chamber hood 231 and a chamber plate 232. The chamber hood 231 is a rigid container that works in concert with the chamber plate 232 to form each openable chamber 23. The chamber hood 231 is detachably and adjacently attached to the chamber plate 232. Thus, the chamber plate 232 seals the chamber hood 231 while the chamber hood 231 is attached to the chamber plate 232. In this way, the chamber hood 231 and chamber plate 232 form a sealed chamber which is evacuated when vacuum sealing a package. The chamber hood 231 is slidably mounted along the central column 21. Consequently, the chamber hood 231 is able to be repositioned along the central column 21. The chamber plate 232 is fixed to the central column 21. Accordingly, the chamber hood 231 is able to move between a closed configuration and an opened configuration with the chamber plate 232. That is, in the closed configuration the chamber hood 231 slides along the central column 21 and rests on the chamber plate 232. In this closed configuration, the chamber hood 231 and chamber plate 232 form a hermetically sealed chamber. Conversely, in the opened configuration the chamber hood 231 slides along the central column 21 and is positioned offset from the chamber plate 232. In this opened configuration, packages can be placed onto, or removed from, the chamber plate 232.

As can be seen in FIG. 4, in the present invention, each of the plurality of openable chambers 23 further comprises a package-ejecting mechanism 236 and at least one package-sealing mechanism 235. The package-sealing mechanism 235 is a device used to seal the packages which are ready to be evacuated by the plurality of openable chambers 23. The package-sealing mechanism 235 is operatively mounted within the chamber hood 231, wherein the package-sealing mechanism 235 is used to seal off a depressurized package by closing and opening the chamber hood 231. This occurs by using a seal bar system and a sealing control system after the chamber is closed. As a result, the package-sealing mechanism 235 is able to cause a package within the plurality of openable chambers 23 to maintain an internal vacuum after the previously depressurized plurality of vacuum chambers is pressurized. The package-sealing mechanism 235 preferably uses heat to seal packages within the plurality of openable chambers 23. However, the package-sealing mechanism 235 may seal packages using adhesives, ultrasound, mechanical fasteners, or similar devices. Once sealed, packages are removed from the plurality of openable chambers 23 by the package-ejecting mechanism 236, which is preferably a conveyor device. The package-ejecting mechanism 236 is operatively integrated into the chamber plate 232, wherein the package-ejecting mechanism 236 is used to move the depressurized package off of the chamber plate 232. Thus, the package-ejecting mechanism 236 is used to clear each openable chamber 23 of packages which have been vacuum sealed. In this way, packages can be moved into each openable chamber 23 by the conveyor system 1 and then moved out of each openable chamber 23 by the package-ejecting mechanism 236. Because of this, the present invention is able to vacuum seal multiple packages without the need for human intervention.

As can be seen in FIG. 2 and FIG. 4, in the preferred embodiment of present invention, the chamber positioning system 3 comprises a track assembly 31, a carriage 32, and a drive mechanism 33. The track assembly 31 is a rail system that the carriage 32 travels on by being slidably engaged along. Consequently, the carriage 32 is able to move from one end of the track assembly 31 to the opposite end unhindered. Additionally, the carriage 32 is fixed to the central column 21, offset from the conveyor system 1. As a result, the carriage 32 is able to move the central column 21 along the track assembly 31. The drive mechanism 33 is mechanically integrated into the slidable engagement between the carriage 32 and the track assembly 31, wherein the mechanism 33 actuates movement of the carriage 32 along the track assembly 31. Thus, the drive mechanism 33 is able to propel the carriage 32 and the attached central column 21 along the track assembly 31. The drive mechanism 33 are preferably, but not limited to being, a belt drive, a chain drive, a hydraulic cylinder, or a motor. In this embodiment, the plurality of openable chambers 23 are linearly arranged about the central column 21. This arrangement enables the drive mechanism 33 to cycle each of the openable chambers to be adjacent to the drop-off end 111 by sliding the carriage along the track assembly 31.

Figure 6:
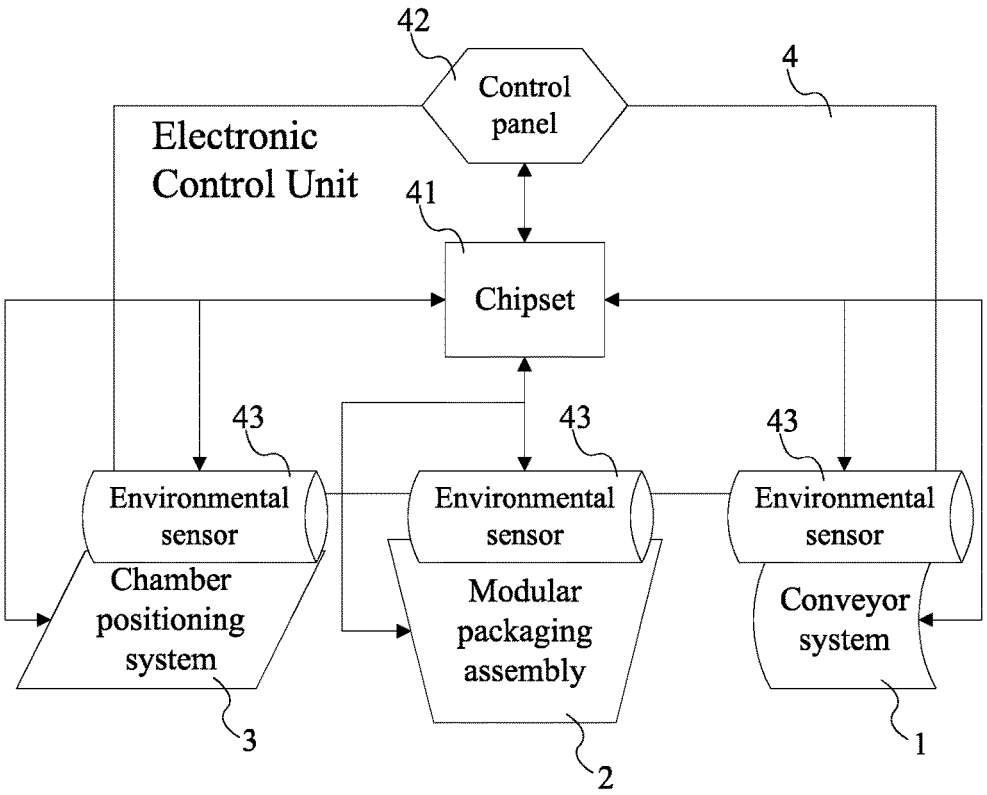
FIG. 6 is a block diagram illustrating the electrical connections between the components of the present invention.

As can be seen in FIG. 2 and FIG. 6, the present invention further comprises an electronic control system. The electronic control system 4 is a computing device that governs the operations of the present invention. The electronic control system 4 comprises a chipset 41 and a control panel 42. The chipset 41 is a computing device with a processor, input and output terminals, and memory. The control panel 42 is a user interface that enables a user to dictate the functions carried out by the present invention. Additionally, the control panel 42 provides the user with visual and audible feedback about the electrical and mechanical state of the present invention. The control panel 42 is electronically connected to the chipset 41. Consequently, user input from the control panel 42 can be relayed to the chipset 41. Additionally, information from the chipset 41 can be relayed to the control panel 42. The chipset 41 is electronically connected to the conveyor system 1, the modular packaging assembly 2, and the chamber positioning system 3. Thus, the chipset 41 is able to send commands to, and receive information from, the conveyor system 1, the modular packaging assembly 2, and the chamber positioning system 3.

As can be seen in FIG. 2 and FIG. 6, in the present invention, the electronic control system 4 further comprises a plurality of environmental sensors 43. The plurality of environmental sensors 43 includes, but is not limited to, temperature sensors, weight sensors, position sensors, motion sensors, pressure sensors, and cameras. The plurality of environmental sensors 43 is integrated into the conveyor system 1, the modular packaging system, and the chamber positioning system 3. Accordingly, the plurality of environmental sensors 43 is used to monitor the environmental state of the present invention. The plurality of environmental sensors 43 is electronically connected to the chipset 41 so that the data gathered by the plurality of environmental sensors 43 can be processed by the chipset 41.

Although the invention has been explained in relation to its preferred embodiment, it is to be understood that many other possible modifications and variations can be made without departing from the spirit and scope of the invention as hereinafter claimed.

What is claimed is:

1. A vacuum sealing apparatus comprising:

a conveyor assembly;

a modular packaging assembly;

a chamber positioning assembly;

the modular packaging assembly comprising a central column, a first openable chamber, a second openable chamber, a first chamber operating device and a second chamber operating device;

the conveyor assembly comprising a proximal belt conveyor, at least one intermediate belt conveyor and a distal belt conveyor;

the proximal belt conveyor being located adjacent to the modular packaging assembly;

the distal belt conveyor being located away from the modular packaging assembly;

the at least one intermediate belt conveyor being located in between the proximal belt conveyor and the distal belt conveyor;

the first openable chamber and the second openable chamber being mounted onto the central column;

the central column being located in between the first openable chamber and the second openable chamber;

the central column, the first openable chamber and the second openable chamber being in a horizontal arrangement;

the chamber positioning assembly being operatively coupled to the modular packaging assembly;

the chamber positioning assembly cycling each of the first openable chamber and the second openable chamber to be adjacent to the proximal belt conveyor;

the chamber positioning assembly comprising a track and a carriage;

the carriage being horizontally slidable along the track;

the carriage being fixed to the central column;

the first openable chamber comprising a first chamber hood and a first chamber plate;

the second openable chamber comprising a second chamber hood and a second chamber plate;

the first chamber plate and the second chamber plate being fixed to the central column;

the central column being fixed in between the first chamber plate and the second chamber plate;

the first chamber hood being detachably attached to the first chamber plate;

the second chamber hood being detachably attached to the second chamber plate;

the central column being located in between the first chamber hood and the second chamber hood;

the first chamber operating device being operatively coupled in between the central column and the first chamber hood;

the first chamber hood being slidably mounted along the central column between a first closed configuration and a first opened configuration via the first chamber operating device driving the first chamber hood;

the first chamber hood resting on the first chamber plate in response to the first chamber hood being in the first closed configuration;

the first chamber hood offsetting from the first chamber plate in response to the first chamber hood being in the first opened configuration;

the second chamber operating device being operatively coupled in between the central column and the second chamber hood;

the second chamber hood being slidably mounted along the central column between a second closed configuration and a second opened configuration via the second chamber operating device driving the second chamber hood;

the second chamber hood resting on the second chamber plate in response to the second chamber hood being in the second closed configuration; and the second chamber hood offsetting from the second chamber plate in response to the second chamber hood being in the second opened configuration.

2. The vacuum sealing apparatus as claimed in claim 1 comprising:

the conveyor assembly comprising a robotic manipulator; and the robotic manipulator being mounted along the conveyor assembly between the proximal belt conveyor and the distal belt conveyor.

3. The vacuum sealing apparatus as claimed in claim 1 comprising:

the modular packaging assembly comprising a vacuum supply pump; and each of the first openable chamber and the second openable chamber being in fluid communication with the vacuum supply pump.

4. The vacuum sealing apparatus as claimed in claim 3 comprising:

the modular packaging assembly comprising a booster pump; and the vacuum supply pump being in fluid communication with the booster pump.

5. The vacuum sealing apparatus as claimed in claim 3 comprising:

the vacuum supply pump being configured to prevent an entry of a liquid.

6. The vacuum sealing apparatus as claimed in claim 1 comprising:

the modular packing assembly comprising a nitrogen supply tank and a nitrogen-recycling pump;

each of the first openable chamber and the second openable chamber being in fluid communication with the nitrogen-recycling pump; and the nitrogen-recycling pump being in fluid communication with the nitrogen supply tank.

7. The vacuum sealing apparatus as claimed in claim 1 comprising:

the modular packing assembly comprising a pressure equalizing manifold;

the first openable chamber being configured to be set at a first pressure;

the second openable chamber being configured to be set at a second pressure;

one of the first pressure and the second pressure being lower than the other of the first pressure and the second pressure in response to the first openable chamber being set at the first pressure and the second openable chamber being set at the second pressure; and the first openable chamber and the second openable chamber being in fluid communication with each other through the pressure equalizing manifold.

8. The vacuum sealing apparatus as claimed in claim 1 comprising:

the first openable chamber comprising a first package-sealing device and a first package-ejecting device;

the second openable chamber comprising a second package-sealing device and a second package-ejecting device;

the first package-sealing device being operatively mounted within the first chamber hood;

the second package-sealing device being operatively mounted within the second chamber hood;

the first package-sealing device being configured to seal off a first depressurized package;

the second package-sealing device being configured to seal off a second depressurized package;

the first package-ejecting device being operatively integrated into the first chamber plate;

the second package-ejecting device being operatively integrated into the second chamber plate;

the first package-ejecting device being configured to move the first depressurized package off of the first chamber plate;

the second package-ejecting device being configured to move the first depressurized package off of the second chamber plate;

the first package-sealing device and the second package-sealing device each being a heater; and the first package-ejecting device and the second package-ejecting device each being a conveyor.

9. The vacuum sealing apparatus as claimed in claim 1 comprising:

the chamber positioning assembly comprising a drive device;

the drive device being mechanically integrated into a slidable engagement between the carriage and the track; and the drive device actuating a movement of the carriage along the track.

10. The vacuum sealing apparatus as claimed in claim 1 comprising:

an electronic control module;

the electronic control module comprising a chipset and a control panel;

the control panel being electronically connected to the chipset; and the chipset being electronically connected to the conveyor assembly, the modular packaging assembly and the chamber positioning assembly.

11. The vacuum sealing apparatus as claimed in claim 10 comprising:

the electronic control module comprising a plurality of environmental sensors;

the plurality of environmental sensors being integrated into the conveyor assembly, the modular packaging assembly and the chamber positioning assembly; and the plurality of environmental sensors being electronically connected to the chipset.

* * * * *